United States Patent [19]

Steinkuhl et al.

[11] Patent Number: 4,934,757

[45] Date of Patent: Jun. 19, 1990

[54] CONTROL OF MINERAL MINING MACHINES

[75] Inventors: Bernd Steinkuhl; Gerhard Merten; Christoph Rassmann, all of Lünen; Alfred Marquart, Bergkamen-Weddinghofen, all of Fed. Rep. of Germany

[73] Assignee: Gewerkschaft Eisenhutte Westfalia GmbH, Lunen, Fed. Rep. of Germany

[21] Appl. No.: 322,951

[22] Filed: Mar. 14, 1989

[30] Foreign Application Priority Data

Mar. 25, 1988 [DE] Fed. Rep. of Germany ..... 3810100

[51] Int. Cl.[5] ..... F21C 27/32; F21C 35/24

[52] U.S. Cl. ..... 299/1; 299/30; 299/34

[58] Field of Search ..... 299/1, 30, 34

[56] References Cited

FOREIGN PATENT DOCUMENTS

| | | | |
|---|---|---|---|
| 3509868 | 3/1985 | Fed. Rep. of Germany . | |
| 3508058 | 9/1986 | Fed. Rep. of Germany | 299/1 |
| 3634599 | 4/1988 | Fed. Rep. of Germany | 299/30 |
| 621887 | 8/1978 | U.S.S.R. | 299/1 |
| 876997 | 11/1981 | U.S.S.R. | 299/30 |
| 914761 | 3/1982 | U.S.S.R. | 299/1 |
| 985280 | 12/1982 | U.S.S.R. | 299/1 |

*Primary Examiner*—Stephen J. Novosad
*Assistant Examiner*—David J. Bagnell
*Attorney, Agent, or Firm*—Sughrue, Mion, Zinn, Macpeak & Seas

[57] ABSTRACT

A coal wining plough in a longwall working employs adjustable floor cutters mounted on curved carriers displaced in guideways on the body of the plough. Wedges abut on the upper ends of the carriers and are moved by hydraulic piston and cylinder units to set the position of the floor cutters and define the cutting level adopted by the plough. The units are operated with the aid of valves which respond to an electronic control device. Command signals from a remote control station are transmitted as by a radio to the plough to set up the electronic control device. Sensors on the plough provide electrical signals representing the position of the interface between the coal face and the floor and these signals are transmitted back to the control station. In a control sequence the plough runs along the seam and the sensor(s) provide signals relayed to the control station which also receives signals representing the distance moved by and/or the position of the plough. On a succeeding run the control station provides the control of the leading floor cutter in accordance with a control program.

11 Claims, 2 Drawing Sheets

CONTROL OF MINERAL MINING MACHINES

FIELD OF THE INVENTION

The present invention relates to a system for, and a method of, controlling the cutting position of a mineral or coal winning machine, such as a plough.

BACKGROUND OF THE INVENTION

It is known to control the position of a leading floor cutter of a plough in order to define the cutting level of the plough. Unless the floor cutter is set correctly the plough tends to climb or dip relative to the floor level. From DE No. 3508058 it is known to control the floor cutters of a plough by a radio telegraphic link between the plough and a control station. In this known arrangement, the plough has hydraulic actuators for adjusting the carriers of the floor cutters. Sensors on these displaceable carriers of the floor cutters detect the positions of the carriers and provide measurement signals which are relayed back to the control station. Any necessary correction of the leading floor cutter is then carried out. Although this known control method allows adjustment and re-adjustment of the floor cutters when the plough is running along the face, i.e. without halting the plough, the cutters are only controlled by sight or on an empirical basis.

To measure the plough cutting horizon with accuracy it is known in general to use probes or sensors which determine the position of the junction or interface between the mineral face or seam and the floor. DE No. 3509868 describes the use of such sensors. In such a control method, the height of the leading floor cutter is adjusted as a function of the seam and floor interface relative to the plough body during each run of the plough and over the entire run producing a relatively rigid and energy-consuming mode of operation. The reliability of operation of this known system can cause problems. To supply the actuators with pressure fluid, a hydropneumatic accumulator is built onto the plough. This accumulator needs to be relatively large in order to provide adequate hydraulic energy. To charge the accumulator a reciprocating pump is included in the drive chain for the plough. Since there is limited space for such a pump its size must be modest and the energy provided is then not sufficient to supply the accumulator without halting the plough and recharging the accumulator from an external source. An electrical power source for energizing the necessary control valves is also provided on the plough but again since the valves switch frequently the power source sometimes requires recharging or replacement involving further halting of the plough.

SUMMARY OF THE INVENTION

A general object of the invention is to effect control of the aforementioned kind with means better adapted to variable operating conditions with higher reliability and minimum energy consumption.

In one aspect, the present invention provides a method of controlling the operating position of a cutting machine or plough by adjustment of a floor cutter comprising the steps of using sensing means on the plough as the plough moves along a mineral face to determine the position of an interface between a floor and the mineral face of the working, transmitting sensing signals derived from the sensing means to a control station, evaluating the signals as well as other signals representing the position and/or displacement of the plough to compute command signals, transmitting the command signals to the plough and utilising the command signals to operate adjustment means to adjust the position of the floor cutter.

The initial measuring run of the plough during which the sensor is operative can be an extraction run, i.e. a working run, during which mineral is stripped from the face. During this measurement run, the leading floor cutter can adopt a neutral position and no adjustments take place. The control station can employ a computer which computes the necessary command signals. At the drive station or the control station a path metering device is often provided to indicate the distance/position of the plough and this device can input directly to the computer. A control program can then be adopted in which the floor profile forms a control variable providing the command signals.

The floor cutter is best adjusted by an hydraulic actuator in response to an electronic control device itself responding to the remotely transmitted command signals. A more or less accurate approximation of the actual course of the interface can be achieved over one or more plough runs depending on the formation and course of the interface. If the floor is highly irregular and/so soft, a level floor can yet be created over successive runs. During the initial measurement run, because there is no adjustment of the floor cutter, the energy requirements are minimized. Indeed the method overall can be carried out reliably with minimal energy needs even with high plough speeds, without pulsating and abruptly reversing control movements.

The method can also be carried out if during the measurement run the measured or sensor signals are stored on the plough and transmitted only when the plough is near the control station. Likewise the command signals can be transmitted when the plough is proximate the control station. This produces a more reliable transfer of data and permits relatively low-powered transmitting/receiving devices to be adopted.

In another aspect the invention provides a plough with adjustable floor cutters, hydraulic actuators for adjusting the position of the floor cutters, a source of pressure fluid, sensing means for sensing the position of an interface between a seam being worked and a floor of the working relative to the plough and a transmitting and receiving device for transmitting signals from the sensing means to a remote control station and for receiving command signals from the control station which are used to adjust the floor cutters. Preferably a valve unit on the plough is operated to control the actuators. This valve unit preferably employs electromagnetic pilot valves operated by an electronic control device in dependence of the received command signals. Those pilot valves then in turn control hydraulic main valves which connect the actuators to the source of pressure fluid and to a return line. By using such pilot valves, which only have to switch low fluid streams, to control the main valves, energy consumption can be minimized and the service life of a battery or batteries providing electrical power can be optimized.

Preferably the pressure fluid source is an hydropneumatic accumulator which works in conjunction with a pump. A rotary pump driven by a wheel mounted on the plough and running along a track or the mineral face can charge the accumulator.

The accumulator need only be relatively small and is easily accommodated on the plough. The energy stored by the accumulator needs to be utilized only when the pump drive is inoperative, say when the wheel loses contact with the track or face, and this does not occur very often.

It is generally sufficient to move the floor cutter between predetermined positions instead of continuously. This simplifies the adjustment and the control some three positions can be adopted in this staged adjustment: a so-called neutral position and positions for making the plough climb or dip. It is advantageous to use a double acting pair of pistons and cylinder units as the hydraulic actuator.

Preferably, the carriers for the adjustable floor cutters are in the form of curved components slidable in guideways on the plough body and contacted by stops. Preferably the stops are in the form of wedge members which are displaced by the actuators.

The invention may be understood more readily, and various other aspects and features of the invention may become apparent from consideration of the following drawings:

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
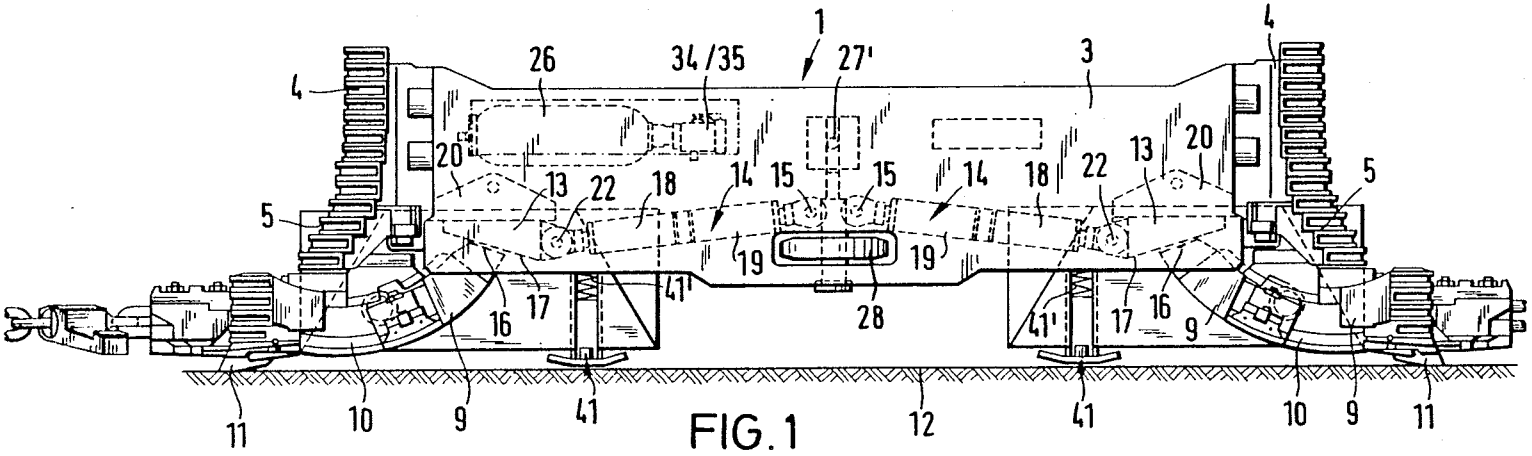
FIG. 1 is a schematic side view of a mineral winning machine constructed in accordance with the invention.
Figure 2:
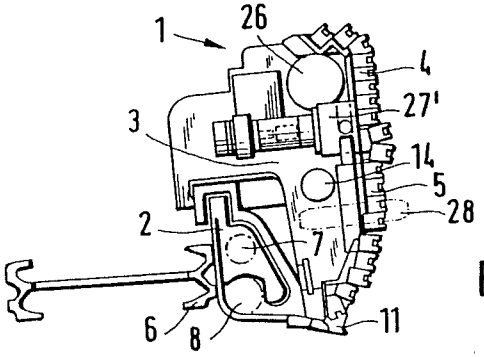
FIG. 2 is an end view of the plough.

FIGS. 1 and 2 depict a mineral winning machine in the form of a plough 1 which is moved back and forth along a longwall mineral, e.g. coal, seam or face to strip mineral from the face. The basic construction of such a machine is well known. The plough 1 is composed of a main body 3 as illustrated or a pair of inter-connected bodies (e.g. as shown in DE No. 3508 058) mounted for movement along a guide 2 (FIG. 2) provided on the mineral face side 6 of a conveyor. The plough 1 is propelled along the guide 2 with the aid of a chain which runs within channels 7, 8 in the guide 2. The end regions of the body 3 is provided with sets of cutter bits 4, 5 mounted on pivotable carriers. As these end regions of the body 3 curved tool carriers 10 are provided. These carriers 10 are guided for slidable displacement in curved guideways 9 defined on the body 3. The carriers 10 have sets of cutters including floor cutters 11 mounted thereto. The floor cutters 11 are special in that they are profiled to possess two cutting edges set at an angle of substantially 90° to one another. One cutting edge runs along the floor of the mine working while the other cutting edge runs along the mineral face. The transition junction or interface between the floor and the mineral face is designated 12 in FIG. 1.

Displacement of the carriers 10 serves to adjust the position of the floor cutters 11 relatively to the body 3. The setting of the floor cutters thus serves to adjust and control the height position of the plough 1. The carriers 10 are displaced by means of wedge members 13 so that the upper ends of the carriers 10 are held in their set positions by the wedge members 13. The wedge members 13 are also mounted in guideways in the plough body 3 for movement along the body 3.

Hydraulic adjustment devices 14 mounted on the body 3 and connected between the body 3 and the associated wedge member 13 with pivot joints 15, 22 serve to displace the wedge members 13 to displace the carriers 10 and control the plough. The floor cutters 11 are associated with sensors 41 which sense the junction or interface 12 between the mineral face and the floor as the plough 1 moves along the working. As shown in FIG. 1, the sensors 41 can be mechanical devices disposed inwardly of the floor cutters 11 and their carriers 10 and, biased towards the interface 12 with spring means 41. The structure and operation of such sensors 41 are well known. During operation the sensors 41 sense the interface 12 and provide electrical sensing signals which are used to control the position of the floor cutters 11 and hence the plough 1. Instead of mechanical sensors 41 optical or electronic sensors can be used for the same purpose.

Figure 3:
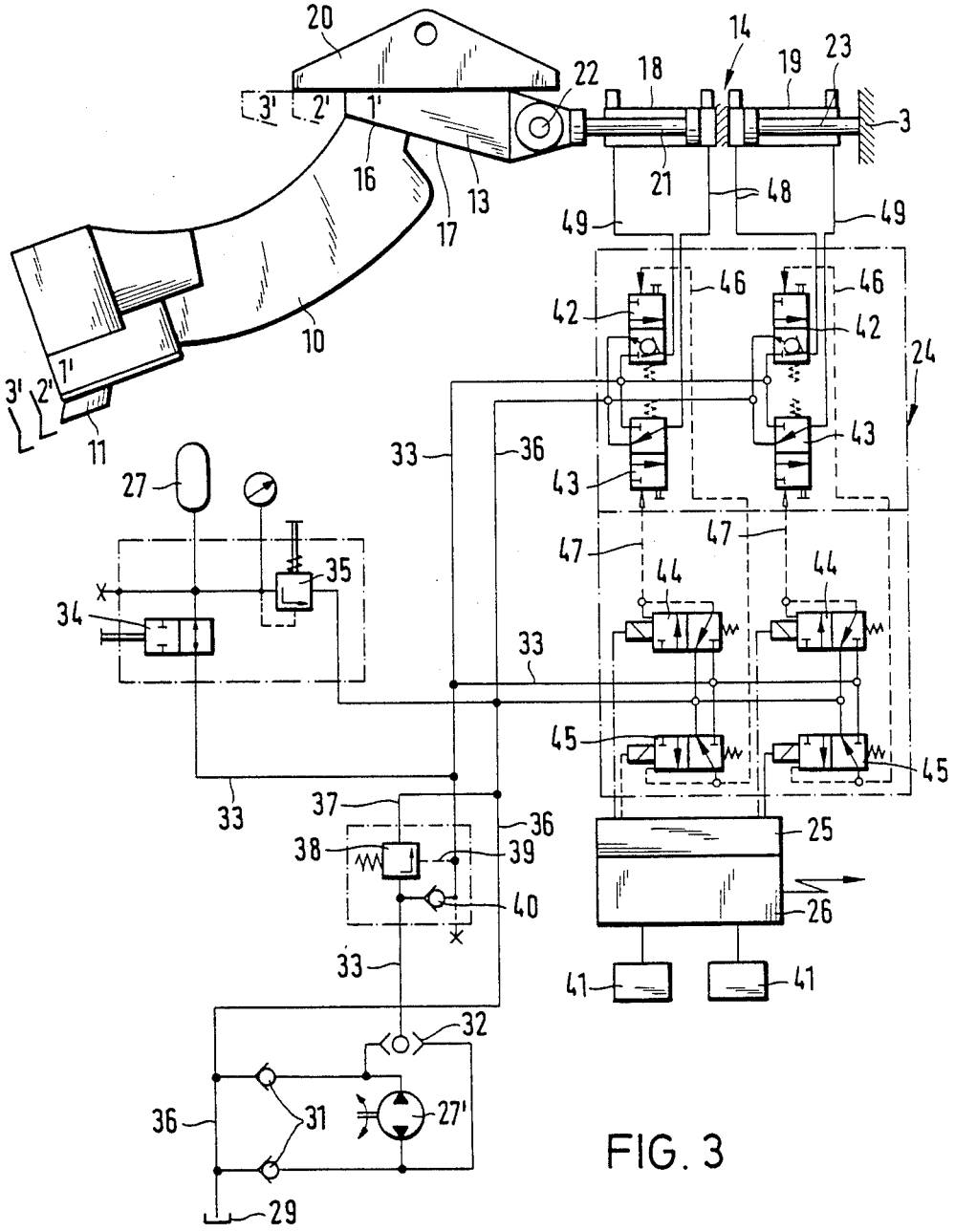
FIG. 3 is a block schematic diagram depicting the control system pertaining to the machine shown in FIGS. 1 and 2.

FIG. 3 shows the control arrangement or system for operating the devices 14. For the sake of clarity only one device 14 is shown together with the associated wedge member 13. The adjustment device 14 takes the form of a pair of combined piston and cylinder units 18,19. The piston rod 21 of the unit 18 is connected with the pivot joint 22 to the wedge member 13 while the piston rod 23 of the unit 19 is connected to the plough body with the pivot joint 15 (FIG. 1). The units 18, 19 are double-acting and pressure fluid is admitted to or discharged from working chambers in the units 18,19 to displace the wedge member 13 between a part 20 of the plough body 3 and the upper end of the carrier 10. It is convenient to move the wedge member 13 between a number of preset positions and three such positions and the corresponding positions for the floor cutter 11 are identified by reference numerals $1^1$, $2^1$, $3^1$ in FIG. 3. The position $2^1$ of the floor cutter 11 can relate to a neutral setting whereat the plough 1 tends to neither climb nor dip while the positions $1^1$ and $3^1$ relate to climb and dip settings respectively.

The pressure fluid for actuating the units 18,19 is provided by a valve unit 24 controlled by an electronic control device 25 having a radio transmitting and receiving device 26. The sensors 41 are connected to the devices 26, 25 and these various devices together with a source of pressure fluid are all mounted on or in the plough body 3. The source of pressure fluid is constituted by a hydropneumatic accumulator 27 drivably connected to a rotating pump 27'. The pump 27' is mounted at the centre of the body 3 and is driven by a drive wheel 28 (FIGS. 1 and 2) which is also mounted in the central region of the plough body 3 for rotation about a vertical shaft. The wheel 28 is rotated as the plough 1 is propelled by the drive chain along the face.

As shown in FIG. 3, the pump 27' is bi-directional and draws in fluid from a reservoir or tank 29 on the plough body 3 via one of two non-return valves 31. A shuttle valve 32 connects the outlet of the pump 27' to a pressure line 33 which leads via a non-return valve 40 and a check valve 34 to the accumulator 27. A pressure-relief valve 35 connects the accumulator 27 to a return line 36 leading back to the reservoir 29. The valve 35 protects the accumulator 27 against excess pressure and this valve 35 can be operated manually when it is desired to empty the accumulator 26. In a branch line 37 connected between the main pressure and return lines 33, 36 there is an idler valve 38 which is controlled via a control line 39 downstream of the non-return valve 40. The idler valve 38 is controlled hydraulically to regulate the pressure in the line 33. When the valve 38 is opened the pump 27' transfers pressure fluid substantially without pressure directly back into the return line 36.

As shown in FIG. 1, the accumulator 26 is mounted with the valves 34, 35 in a horizontal protected disposition in the upper part of the plough body 3.

The valve unit 24 is controlled by electrical signals generated by the device 25 to selectively connect the main pressure and return lines 33, 36 to the working chambers of the units 18,19. For each unit 18,19 there are two main hydraulic control valves 42,43 and two electro-magnetic pilot valves 44,45. The main valves 42,43 are hydraulically controlled via hydraulic control lines 46,47. The valves 42,43 are two state three port valves each with ports connected to the pressure and return lines 33,36 and a port connected via a line 48,49 to the working chambers of the units 18,19. The pilot valves 44,45 are also two state three port valves with ports connected to the pressure and return lines 33,36 and a control port connected to the control lines 46,47 of the valves 42,43. The pilot valves 44,45 are controlled by the control signals provided by the device 25. When energized the valves 44,45 connect the lines 46,47 to the pressure line 33 to actuate the valves 42,43 to connect the appropriate working chambers of the units 18,19 to the pressure and return lines 33, 36. The wedge member 13 is thence displaced as the units 18,19 extend or retract in unison. It is, however, possible to modify the control system so that the units 19,18 are controlled separately. Another contemplated modification would be to have one piston and cylinder unit for each setting position $1^1$, $2^1$ and $3^1$.

The use of the pilot valves 44,45 permits low flows of fluid to be used to switch the main valves 42,43 and the switching forces are consequently quite low as is the power requirement to switch the valves 44,45.

Conveniently, a common electrical power source such as a battery, can be provided on the plough body 3 or as a constructional part of the devices 25 26 which are also powered by this source. If the sensors 41 are electronic or opto-electronic then the electrical power source can supply power to these probes also.

During use of the control system, the plough 1 is controlled with some accuracy by adjustment of the leading floor cutter 11 to hold the plough 1 at a desired level so that undesirable climbing or dipping movements do not occur. Any deviation from the desired height level is detected by the relevant sensors 41 and used directly or indirectly to cause the device 25 to operate the valve unit 24 to provide a compensatory adjustment of the floor cutter 11. In the system as described the signals from active sensor 41 are transmitted via the device 26 by radio or some other remote non-contacting link to a central control station usually at one end of the longwall working. This control station would have a control computer which evaluates the signals from the sensor 41 as well as other signals provided by other monitoring or control equipment. With a typical plough installation it would be normal to use measuring devices to determine the distance of movement and/or location of the plough and to relay these measurement signals back to the computer of the control station. The computer can then compute from all the signals it is receiving, the desired course for the interface 12. A control signal transferred back to the device 26 from the control station and representing the desired course for the interface 12 is then used to control the device 25 and the valve unit 24 in the manner described hereinbefore.

In a preferred method of control the plough 1 performs an initial run and the leading sensor 41 provides the sensing signals which are used to determine the prevailing dynamic position of the interface 12. On the succeeding run the leading floor cutter 11 is adjusted in accordance with the setting chosen by the computer. During this succeeding run it is not essential that the sensor signals be utilized and thus the control sequence can consist of measuring runs when the sensor signals are utilized and adjustment runs when the leading cutter 11 is re-adjusted. These runs can take place with certain time intervals therebetween.

In another modified control method the signals from the active sensor 41 are stored by a memory device on the plough 1 and are subsequently transmitted to the control station when the plough is close to the latter and the transmission distance is relatively small. The appropriate control commands provided by the control station can also be transmitted only when the plough 1 is close and if desired these commands can also be stored.

We claim:

1. A method of controlling the operating position of a mineral winning machine, propelled back and forth alongside a mineral face in a mine working, by adjustment of a floor cutter of the machine, said method comprising:

causing the machine to perform a first run along the mineral face, sensing with sensing means on the machine the position of an interface between the mineral face and the floor of the working in relation to the machine, storing data signals from the sensing means for subsequent transmission of the data signals when the machine approaches control station and is in proximity thereto, transmitting said data signals from the machine and representing the sensing data to said remote control station which also receives other data pertaining to the operation of the machine, evaluating said data at the remote control station and deriving command signals, transmitting said command signals from the control station, derived from evaluation of the sensing and other data, to the machine during a subsequent run, and adjusting the floor cutter of the machine in accordance with said command signals.

2. A method according to claim 1, wherein the sensing and command signals are transmitted by radio.

3. A method of controlling the operating position of a mineral winning machine, propelled back and forth alongside a mineral face in a mine working, by adjustment of a floor cutter of the machine in response to comments from a remote control station, said method comprising:

causing the machine to perform a first run along the mineral face, sensing with sensing means on the machine the position of an interface between the mineral face and the floor of the working in relation to the machine.

storing data signals from the sensing means for subsequent transmission of the data signals when the machine approaches the remote control station and is in proximity thereto, transmitting said data signals from the machine and representing the sensing data to the remote control station which also receives other data pertaining to the operation of the machine.

evaluating said data at the remote control station and deriving command signals, transmitting said command signals from the remote control station, derived from evaluation of the sensing and other data, to the machine during a subsequent run, the command signals being transmitted to the machine as the latter is in proximity to the remote control station and these command signals are determined by a control program and adjusting the floor cutter of the machine in accordance with said command signals.

4. A mineral winning machine controlled from a remote station comprising:

at least one body which is propelled back and forth along a mineral face of a mine working having a floor, at least one adjustable floor cutter on the body which can be set to determine the cutting horizon adopted by the machine during its passage along the face, an hydraulic actuator on the body for effecting the adjustment of the floor cutter, a source of pressure fluid carried by the body, pressure and return lines associated with said source, sensing means on the body for sensing the position of an interface between the mineral face and the floor, a plurality of hydraulic valves on the body, including at least one electromagnetic pilot valve, the valves being operable to selectively connect the pressure and return lines to the actuator, electronic control means on the body for controlling the pilot valve and hence the operation of the other valve or valves, and a transmitting and receiving device which transmits data signals provided by the sensing means to the remote control station and which receives command signals from the remote control station for effecting the control of said pilot valve by the control means.

5. A machine according to claim 4, wherein the pressure source is a hydropneumatic accumulator and there is further provided a pump on the body for charging the accumulator with pressure fluid and drive means for driving the pump as the machine moves along the face.

6. A machine according to claim 5 wherein the pump drive means is a rotatable wheel.

7. A machine according to claim 5 and further comprising an hydraulically operated idler valve for opening and closing a connection between the outlet of the pump and a return line in accordance with the pressure of the fluid in a main pressure line.

8. A machine according to claim 4, wherein there is further provided a storage device for storing data representing measuring signals provided by the sensing means, the stored data being transmitted to the control station in response to another command signal from the control station.

9. A machine according to claim 4, wherein the hydraulic actuator serves to adjust the floor cutter into one of a plurality of pre-set positions.

10. A machine according to claim 9, wherein the actuator is a pair of double acting piston and cylinder units.

11. A machine according to claim 4, wherein the floor cutter is mounted on a curvilinear carrier slidably displaceable in a guideway and a upper end of the carrier abuts on a wedge member displaced by the hydraulic actuator.

* * * * *